US008256644B2

(12) United States Patent
Orgna

(10) Patent No.: US 8,256,644 B2
(45) Date of Patent: Sep. 4, 2012

(54) DISPENSER

(75) Inventor: Peter Orgna, Gothenburg (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 12/067,047

(22) PCT Filed: Sep. 20, 2005

(86) PCT No.: PCT/SE2005/001378

§ 371 (c)(1),
(2), (4) Date: Mar. 17, 2008

(87) PCT Pub. No.: WO2007/035139

PCT Pub. Date: Mar. 29, 2007

(65) Prior Publication Data

US 2008/0257906 A1 Oct. 23, 2008

(51) Int. Cl.
*A47K 10/30* (2006.01)

(52) U.S. Cl. ..... 221/45; 221/62

(58) Field of Classification Search ..... 221/1–312 C
See application file for complete search history.

(56) References Cited

U.S. PATENT DOCUMENTS

| | | | | | |
|---|---|---|---|---|---|
| 1,016,270 | A | * | 2/1912 | Johnson | 226/130 |
| 1,688,242 | A | * | 10/1928 | Lawrence et al. | 221/34 |
| 1,712,479 | A | * | 5/1929 | Allen et al. | 221/53 |
| 2,487,763 | A | * | 11/1949 | Patterson et al. | 242/598.6 |
| 2,902,187 | A | * | 9/1959 | Cabanban | 221/240 |
| 3,084,006 | A | * | 4/1963 | Roemer | 312/34.22 |
| 3,151,771 | A | * | 10/1964 | Greene | 221/26 |
| 3,167,367 | A | * | 1/1965 | Rozlog et al. | 242/564.4 |
| 3,319,835 | A | | 5/1967 | Ensign et al. | |
| 3,387,902 | A | * | 6/1968 | Perrin et al. | 312/34.22 |
| 4,406,421 | A | * | 9/1983 | Schultz et al. | 242/564.4 |
| 4,484,694 | A | * | 11/1984 | Reuteman et al. | 221/197 |
| 4,666,099 | A | | 5/1987 | Hoffman et al. | |
| 5,037,000 | A | * | 8/1991 | Selame | 221/303 |
| 5,137,173 | A | * | 8/1992 | Hughes et al. | 221/34 |
| 5,628,474 | A | * | 5/1997 | Krueger et al. | 242/559.4 |
| 5,772,291 | A | | 6/1998 | Byrd et al. | |

(Continued)

FOREIGN PATENT DOCUMENTS

CN 2164775 5/1994

(Continued)

OTHER PUBLICATIONS

Russian Office Action dated Apr. 24, 2009 from corresponding RU 2008115495.

*Primary Examiner* — Gene Crawford
*Assistant Examiner* — Kelvin L Randall, Jr.
(74) *Attorney, Agent, or Firm* — Young & Thompson

(57) ABSTRACT

The invention relates to a dispenser for hygiene products, which dispenser comprises a rear section (2, 22, 32), two side sections (3, 4; 23, 24;33, 34), a front section (5, 25, 35), an upper section (6, 26, 36) and a lower section (7, 27, 37) having means for dispensing hygiene products. At least the rear section (2, 22, 32) and the two side sections (3, 4; 23, 24;33, 34) comprise substantially flat components made from a plastic material, and that the front section (5, 25, 35) and the upper section (6, 26, 36) form a single sheet metal component having at least one cylindrical single-curvature bend.

26 Claims, 6 Drawing Sheets

U.S. PATENT DOCUMENTS

| | | | | |
|---|---|---|---|---|
| 5,957,324 | A * | 9/1999 | Gettelman et al. | 221/55 |
| 6,082,664 | A * | 7/2000 | Phelps et al. | 242/596.5 |
| D441,581 | S * | 5/2001 | Andersson | D6/545 |
| 6,412,655 | B1 | 7/2002 | Stuetzel et al. | |
| 6,412,679 | B2 * | 7/2002 | Formon et al. | 225/14 |
| 6,736,348 | B1 * | 5/2004 | Formon et al. | 242/560.1 |
| 6,988,635 | B2 * | 1/2006 | Hochtritt et al. | 221/44 |
| 2003/0127470 | A1 | 7/2003 | DeKoning et al. | |
| 2005/0016230 | A1 * | 1/2005 | Lum et al. | 70/159 |
| 2005/0056656 | A1 * | 3/2005 | Hochtritt et al. | 221/45 |
| 2005/0199641 | A1 * | 9/2005 | Yang et al. | 221/1 |
| 2007/0257061 | A1 * | 11/2007 | Ophardt | 222/181.3 |

FOREIGN PATENT DOCUMENTS

| | | | |
|---|---|---|---|
| EP | 1 538 961 | B1 | 11/2006 |
| ES | 2 275 111 | T3 | 6/2007 |
| GB | 1 143 948 | A | 2/1969 |
| GB | 1392137 | | 4/1975 |
| WO | 2005/108652 | A1 | 11/2005 |

* cited by examiner

DISPENSER

TECHNICAL FIELD

The present invention relates to a dispenser for hygiene products. The dispenser comprises a small number of simple components which can be manufactured without complex shaping or machining and without requiring welding, making the dispenser easy and cost effective to manufacture.

BACKGROUND ART

Dispensers for various types of hygiene products are often made from sheet metal sections, which sections are typically welded or riveted together to form the final product. The sheet metal used is often steel sheet which is a cheap material that is easy to work or machine. However, when shaping steel sheet, for instance by drawing or pressing, to form individual parts the material is often deformed adjacent curvatures or when making double curvature sheet profiles. Additional working of the sheet material will be required if, for instance, a window for indicating the level of hygiene products remaining in the dispenser. Subsequent welding, such as spot welding, may warp the product and/or leave marks on the outer surface, even after a final surface treatment or painting. The final product is relatively heavy and is susceptible to corrosion, in particular if the surface coating is scratched or damaged. A product of this type is also subject to design limitations due to the use of welding, as the product must be designed to allow access for welding equipment during the assembly process.

Making dispensers of a plastic material could solve some of the above problems. For instance, double curvature shapes are possible to produce without risking deformation, problems relating to marks left by spot welding can be eliminated and the end product would be lighter. However, tooling costs for moulds for double curvature shapes are relatively high and a plastic material is also more susceptible to scratches and wear than sheet metal. Also, an all plastic dispenser, with or without a double curvature design, may have a lower structural stability and may require a greater material thickness and/or reinforcing ribs to prevent the dispenser from yielding or cracking when in use. At the same time, a thicker and/or reinforced material will inherently be heavier and may not be suitable for use in all components making up a dispenser. From a design point of view, the balance between shape, function and inherent properties of a desired plastic material may create problems.

This invention aims to solve these problems by providing a dispenser that is structurally stable and can be manufactured without complex shaping or machining and without requiring welding. This makes the dispenser easy and cost effective to manufacture.

DISCLOSURE OF INVENTION

The invention relates to a dispenser for hygiene products.

According to a preferred embodiment, the invention relates to a dispenser for hygiene products, which dispenser comprises a rear section, two side sections, a front section, an upper section and a lower section having means for dispensing hygiene products. The rear section, the two side sections and the lower section comprise substantially flat components made from a plastic material. The front section and the upper section form a single sheet metal component having at least one cylindrical single-curvature bend. The rear section, the two side sections and the front section are preferably, but not necessarily, arranged in substantially vertical planes. The upper section and the lower dispensing section may each be arranged either in a substantially horizontal plane, or at an angle downwards or upwards respectively to the horizontal plane.

Here, a cylindrical single-curvature bend is defined as a sheet that is bent in one direction only. Typical examples of such a single-curvature bend are cylindrical sheets or extruded sections where the generatrices forming a bend are parallel between the outer edges of the material. This can be compared to compound curvature or double curvature shapes, where the material may be deformed in two planes to form a three dimensional shape.

Accordingly, one or both of the front section and the upper section may be flat, wherein the sections are joined by a cylindrical single-curvature bend. Alternatively, one or both of the front section and the upper section may have a constant or varying cylindrical single-curvature with a relatively large radius, wherein the sections are joined by a cylindrical single-curvature bend with a relatively small radius. The sheet metal component making up the front section and upper section can be made from a single sheet that is shaped in a single operation. The thickness of the sheet metal may be selected depending on the metal used and/or the size of the component. For instance, for a relatively small component a relatively thin sheet thickness may be used, while a larger component may require a larger thickness to maintain it structural rigidity and to avoid bending of the component when it is opened. Any suitable sheet metal may be used, but according to a preferred embodiment aluminium is used. The aluminium sheet may be anodized prior to any shaping or machining operation, wherein anodizing gives a durable and scratch resistant surface. Alternatively, the aluminium sheet can be anodized after all shaping and machining operations have been completed. This allows the anodizing to be performed on all sides of the sheet metal component, including the side edges.

The thickness of the sheet metal used may vary depending on size and/or type of dispenser. Examples of thicknesses may be 2-3 mm for aluminum or 0.7-1.5 mm for stainless steel.

An example of a radius for a relatively small cylindrical single-curvature bend joining an upper and a front section may be about 8 mm, measured at the outer surface of and in a cross-section taken at right angles to the parallel generatrices forming the bend. This radius may of course vary with the size of the dispenser and the material selected. For a stainless steel sheet, the radius may be selected from about 5 mm or more, while an anodized aluminium sheet may be selected from about 8 mm or more. For this example, the upper section may either have a radius of 160-590 mm, or have the shape of a continuous or discontinuous curve. Similarly, the front section may either have a radius of 860-2550 mm, or have the shape of a continuous or discontinuous curve. According to these examples, when both the front section and the upper section are curved, then the upper section will have a smaller radius of curvature the front section. The shape of each of the upper and front sections respectively may of course be varied from being flat to having a radius or a predetermined curvature. A section having a discontinuous curve may comprise a combination of curved and flat sections, wherein a curved section may include one or more inflection points. Common for all bends or curves as defined above is that all generatrices forming said bends and curves are parallel.

By making the rear and side sections substantially flat, the manufacturing process can be kept simple and tooling cost is relatively low. One or both side sections may be provided with a level indicator, to allow the level or quantity of dispensed material remaining in the dispenser to be inspected from the outside. Such indicators may take the form of at least one entirely transparent side section, or a transparent window in a partially transparent or opaque side section. When a window is provided, the remaining surface of the side section may be frosted or structured, rendering the side section more or less transparent.

In order to refill the dispenser, at least the sheet metal component is arranged to be folded about a pair of pivot means arranged in the side sections.

According to one embodiment, the pivot means may be arranged to connect the sheet metal component and the side sections. In this case, a pivot joint, a linkage or similar may connect a lower end of a separate sheet metal component, comprising the front and upper section, with a lower, front section of each side section. The side sections and the lower dispensing section may be permanently joined to the rear section to form a single unit. The join may be achieved by adhesive and/or mechanical means. The rear section may be provided with through holes or other means for attaching it to a wall surface.

According to an alternative embodiment, the sheet metal component may be attached to the side sections and the pivot means may be arranged to connect the rear section and the side sections. The sheet metal component comprising the front and upper section may be adhesively and/or mechanically assembled to the side sections. The sheet metal component may be attached in slots along front and upper edges of the side sections. The pivot means may be pivot joints arranged adjacent the lower section, preferably at a lower, inner end of the side sections and the lower section or the rear section respectively. The pivot joints may comprise a protrusion in each side section arranged to cooperate with a corresponding recess in a side surface of the lower section or the rear section.

The sheet metal component may preferably, but not necessarily, be made from aluminium. As stated above, the aluminium sheet component may be anodized on all surfaces. Of the remaining sections, at least the side sections comprise a transparent plastic material. By making the entire side section or a predetermined part thereof transparent, it is possible to check the level of the product contained within the dispenser. For instance, the side surfaces may be made from a clear or coloured plastic material and/or be fully or partially frosted, structured or opaque during manufacture of the side section. The lower section may be a separate section that is adhesively and/or mechanically attached to the rear section, or be an integral part of the rear section.

Suitable plastic materials for the rear section, the side section and the lower section are polycarbonate, polystyrene acrylonitrile butadiene styrene (ABS), polymethylmethacrylate (PMMA), or any other suitable plastic materials.

According to one embodiment, the lower section is provided with means for dispensing liquid or viscous materials, such as soap. According to an alternative embodiment, the lower section is provided with means for dispensing sheets of paper from a stack of interfolded or separate sheets, such as hand towels or facial tissues, or a roll of interconnected sheets, such as a roll of toilet paper, with or without perforations.

BRIEF DESCRIPTION OF DRAWINGS

In the following text, the invention will be described in detail with reference to the attached drawings. These schematic drawings are used for illustration only and do not in any way limit the scope of the invention. In the drawings.

EMBODIMENTS OF THE INVENTION

Figure 1A:
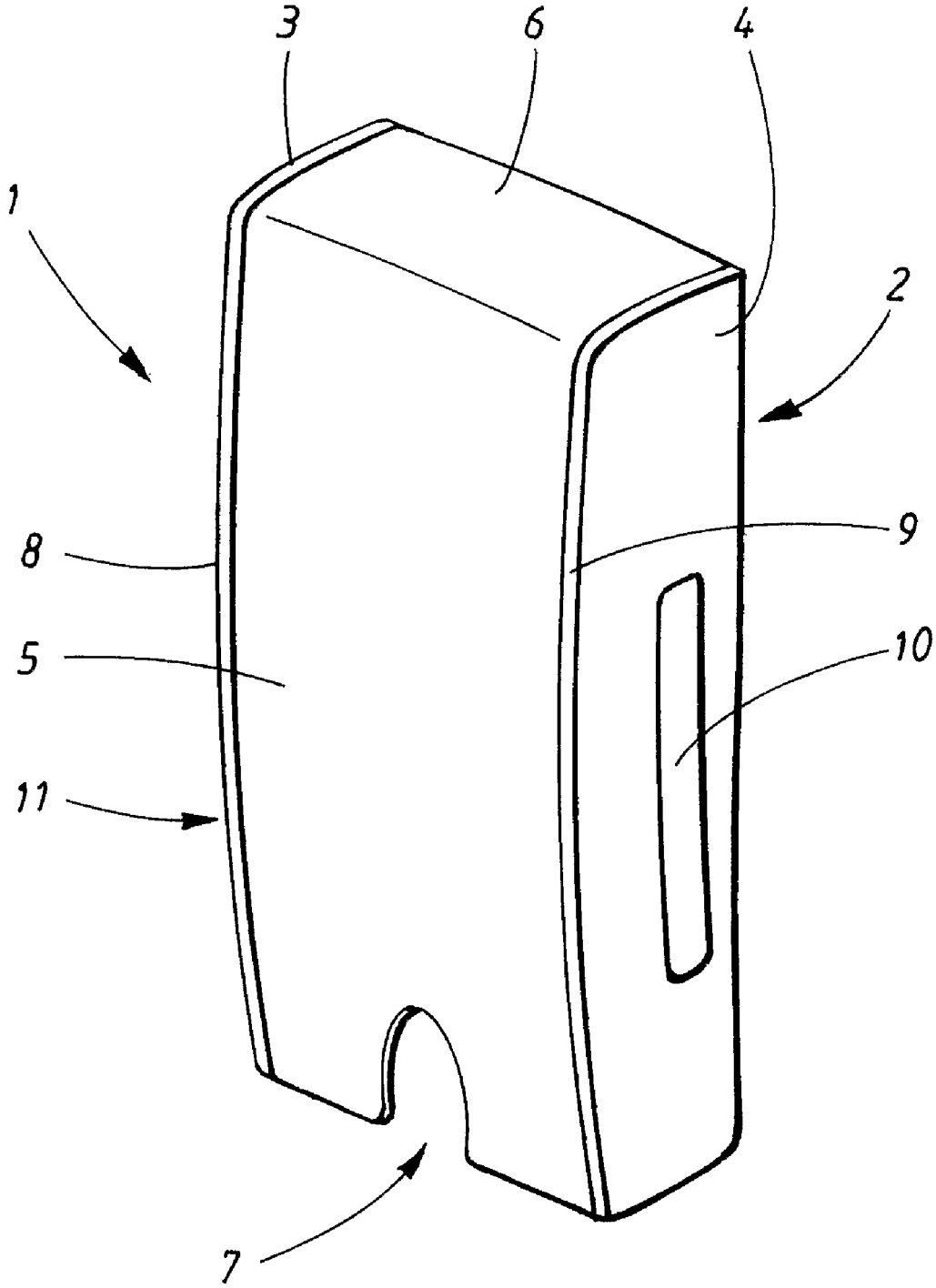
FIG. 1A shows a perspective view of a dispenser for hand towels.

FIG. 1A shows a perspective view of a dispenser 1 for hand towels according to the invention. The dispenser 1 comprises a rear section 2 (see FIG. 1B), two side sections 3, 4, a front section 5, an upper section 6 and a lower section 7 (see FIG. 1B) having means for dispensing paper hand towels. The figure shows the front section 5 and the upper section 6 forming a single sheet metal component having at least one cylindrical single-curvature bend, while the rear section 2 and the side sections 3, 4 are flat components. The front section 5 and the upper section 6 are also curved in the same way in a direction away from the relatively sharp bend joining the surfaces to conform to the contour of each front edge 8, 9 of the side sections 3, 4. An inner surface of the side edges of the front section 5 and the upper section 6 are arranged to rest against cooperating contact surfaces extending at right angles from the inner surface of the side sections 3, 4. When the front section 5 and the upper section 6 are closed, their outer surfaces should be substantially flush with the front edges 8, 9 of the side sections 3, 4. The side sections 3, 4 are also provided with level indicators 10, 11, wherein the level indicators form clear windows in an otherwise opaque surface. It is of course possible to provide the dispenser with only one indicator of this type.

Figure 1B:
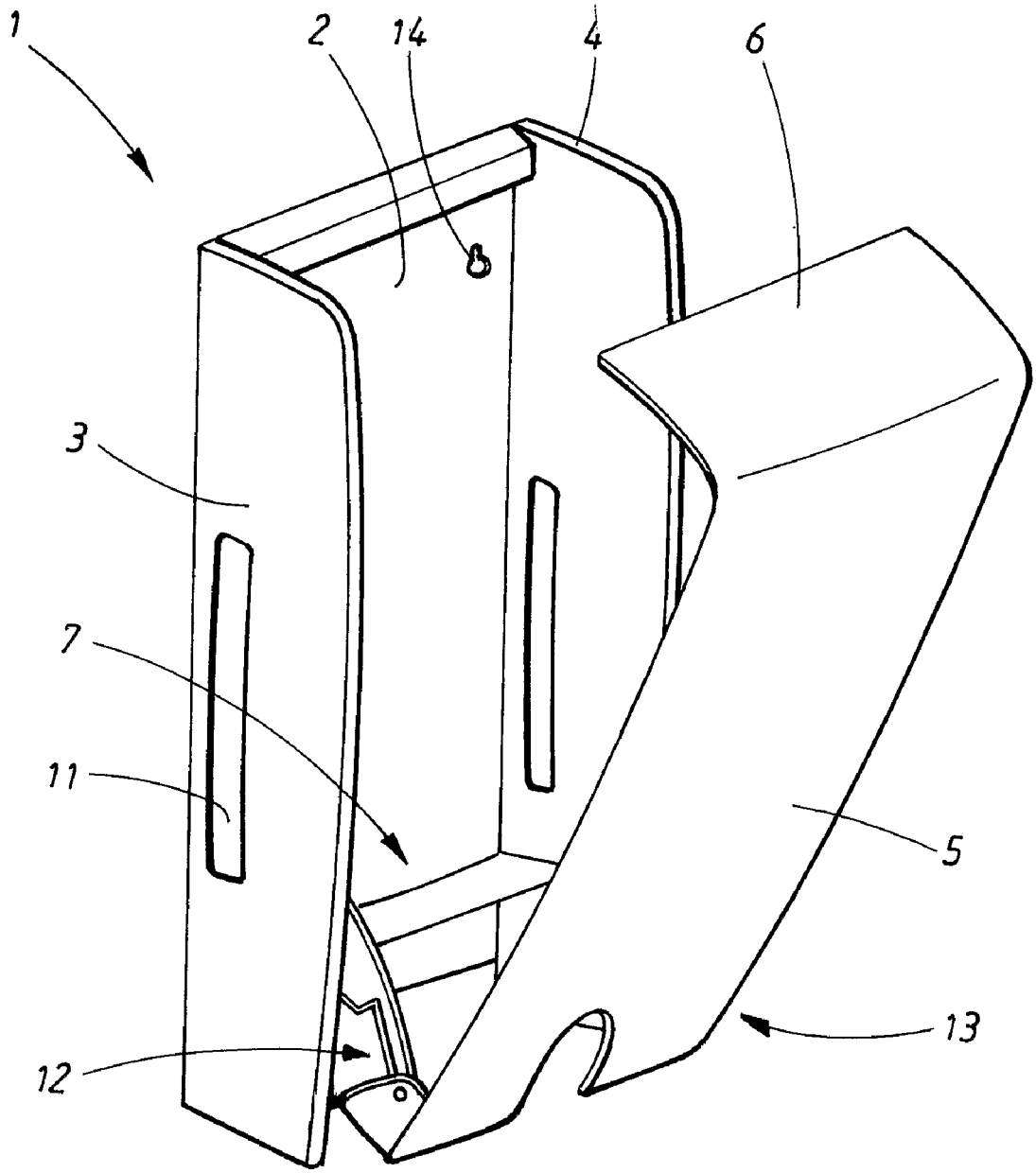
FIG. 1B shows the dispenser in FIG. 1A in a partially open position.

FIG. 1B shows the dispenser of FIG. 1 in a partially opened position prior to re-filling the dispenser. The figure shows how a sheet metal cover formed by the front section 5 and the upper section 6 is attached to the inner surfaces of the side sections 3, 4 by a linkage 12, 13, allowing the cover 5, 6 to be folded forwards and outwards to enable re-filling of the dispenser. After refilling the cover 5, 6 is folded back into its closed position, where it is held by a locking means (not shown) connecting the upper section 6 to the rear section 2. The side sections 3, 4 are permanently attached to the rear section 2, which is also provided with attachment holes 14 (one shown) for fastening the dispenser to a wall surface.

Figure 2A:
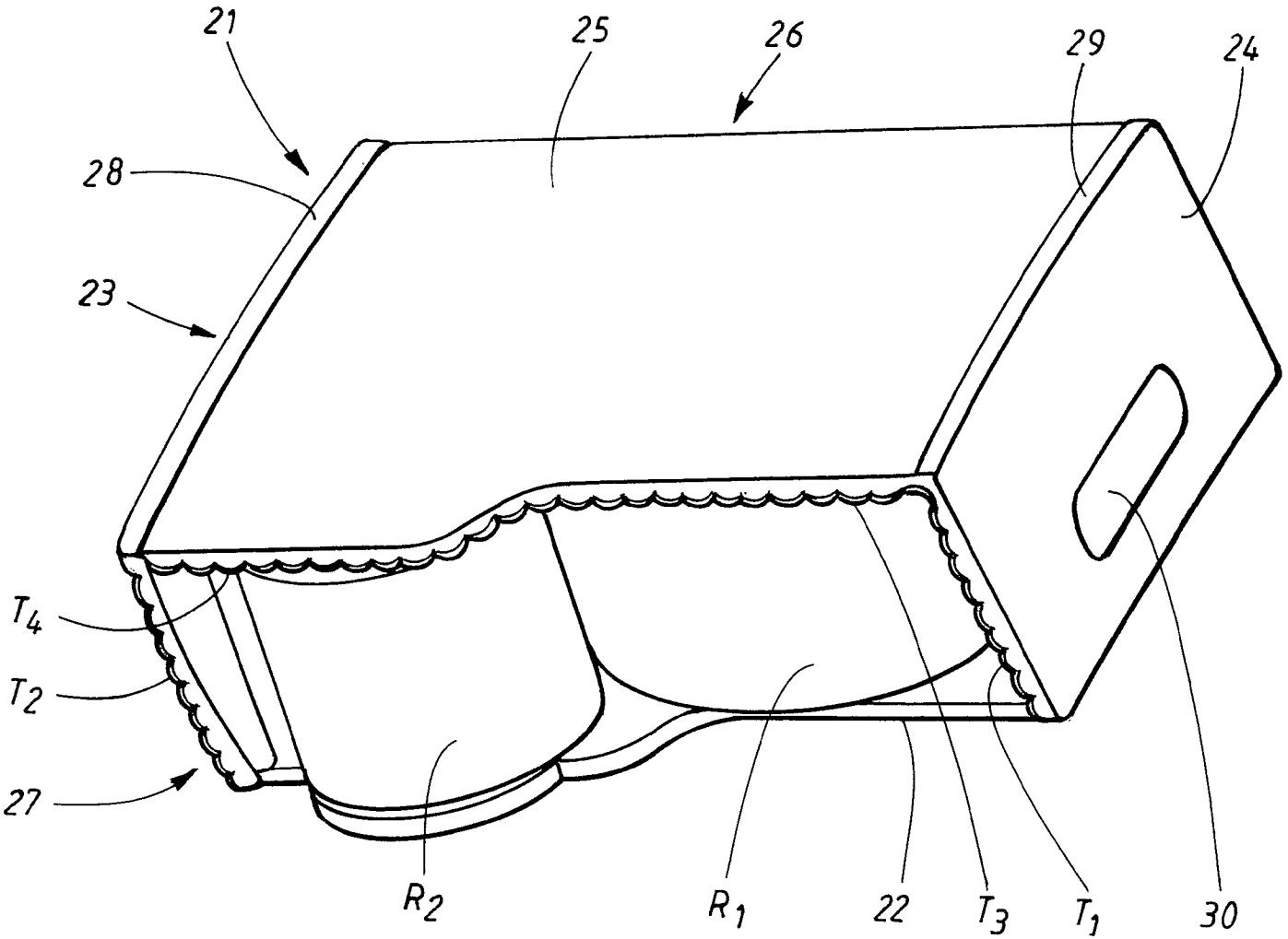
FIG. 2A shows a perspective view of a dispenser for toilet paper.

FIG. 2A shows a perspective view of a dispenser 21 for toilet paper. The dispenser 21 comprises a rear section 22, two side sections 23, 24, a front section 25, an upper section 26 and a lower section 27 having means for dispensing toilet paper. The figure shows the front section 25 and the upper section 26 forming a single sheet metal component being joined at a cylindrical single-curvature bend, while the rear section 22 and the side sections 23, 24 are substantially flat components. In this embodiment, the lower section 27 comprises a dispensing means in the form of an opening allowing a user free access to a main roll $R_1$ or a stub roll $R_2$ of paper. The lower edges of the side and front sections 23, 24, 25 surrounding the opening are provided with substantially horizontal tear edges $T_1$, $T_2$, $T_3$, $T_4$. located substantially level with, or just below, their associated roll. As can be seen from FIG. 2A, the stub roll $R_2$ is located to one side of and lower down than the main roll $R_1$. Consequently, the tear edges $T_2$, $T_4$ adjacent the stub roll $R_2$ are located lower down than the tear edges $T_1$, $T_3$ for the main roll $R_1$, wherein the tear edges $T_3$, $T_4$ along the lower edge of the front section 25 are joined by an angled tear edge. The front section 25 and the upper section 26 are also curved in a direction away from the relatively sharp bend joining the section to conform to the contour of each front edge 28, 29 of the side sections 23, 24. An inner surface of the side edges of the front section 25 and the upper section 26 are arranged to rest against cooperating contact surfaces extending at right angles from the inner surface of the side sections 23, 24 adjacent the front edges 28, 29. When the front section 25 and the upper section 26 are closed, their outer surfaces should be substantially flush with the front edges 28, 29 of the side sections 23, 24. The side sections 23, 24 are also provided with level indicators 30 (only one shown) wherein the level indicators form clear windows in an otherwise opaque surface.

Figure 2B:
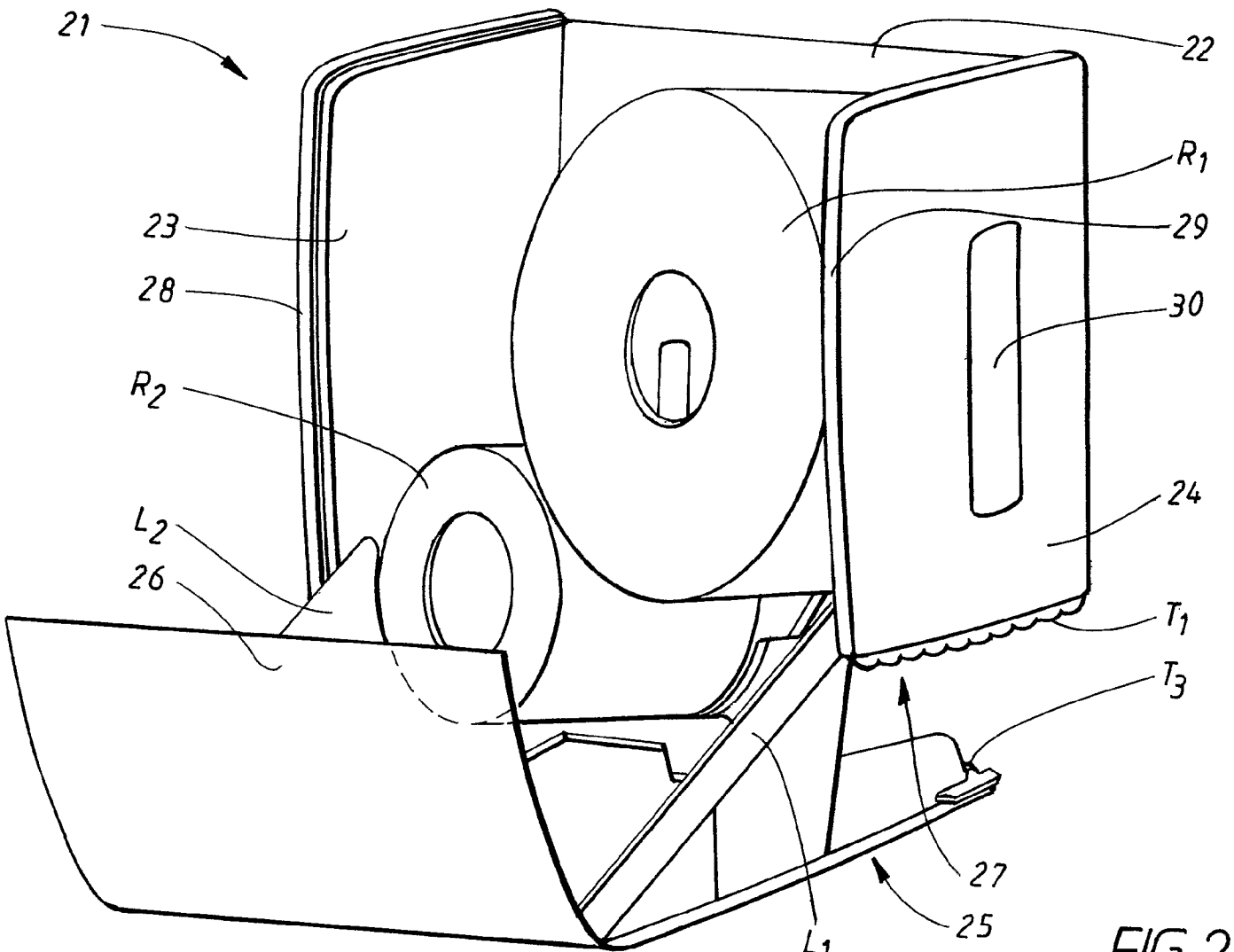
FIG. 2B shows the dispenser in FIG. 2A in an open position.

FIG. 2B shows the dispenser of FIG. 2A in an opened position after a re-filling of the dispenser, wherein a partially used main roll has been moved to the stub roll $R_2$ position and a new main roll $R_1$ has been mounted. The figure shows how a sheet metal cover formed by the front section 25 and the upper section 26 is attached to the inner surfaces of the side sections 23, 24 by a linkage L1. L2, allowing the cover 25, 26 to be folded forwards and outwards to enable re-filling of the dispenser. After re-filling the cover 25, 26 is folded back into its closed position, where it is held by a locking means (not shown) connecting the upper section 26 to the rear section 22. The side sections 23, 24 are permanently attached to the rear section 22, which is also provided with attachment holes (not shown) for fastening the dispenser to a wall surface.

Figure 3A:
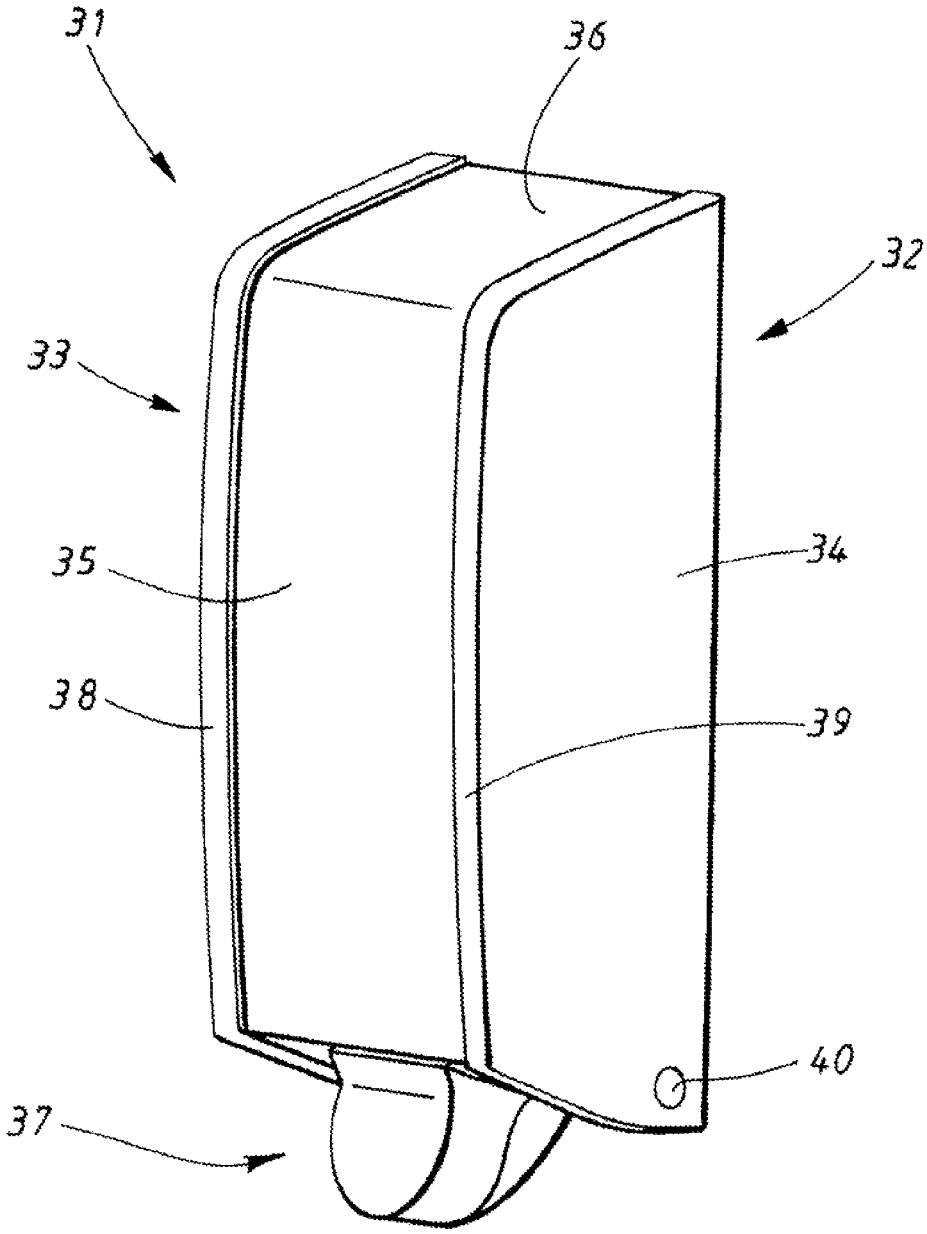
FIG. 3A shows a perspective view of a dispenser for liquid materials.

FIG. 3A shows a perspective view of a dispenser 31 for liquid or viscous materials; in the current example the material is soap. The dispenser 31 comprises a rear section 32 (see FIG. 3B), two side sections 33, 34, a front section 35, an upper section 36 and a lower section 37 (see FIG. 3B) having means for dispensing soap. The figure shows the front section 35 and the upper section 36 forming a single sheet metal component having at least one cylindrical single-curvature bend, while the rear section 32 and the side sections 33, 34 are substantially flat components. In this embodiment, the lower section 37, comprising a dispensing unit, is made in one piece with the rear section 32. The front section 35 and the upper section 36 are also curved in the same way in a direction away from the relatively sharp bend to conform to the contour of each front edge 38, 39 of the side sections 33, 34. The front edges 38, 39 of the side sections 33, 34 are provided with slots in which each respective side edge of the front section 35 and the upper section 36 are inserted and adhesively attached. In this way, side sections 33, 34, the front section 35 and the upper section 36 form a single unit that can be folded outwards and forwards around a pivot means. The pivot means is a pair of pivot joints 40 (only one shown) arranged at a lower, inner end of the side sections 33, 34 and the lower section or the rear section respectively. The pivot joints 40 comprise a protrusion in each side section 33, 34 arranged to cooperate with a corresponding recess in a side surface of the integrated lower section 37 and the rear section 32.

Figure 3B:
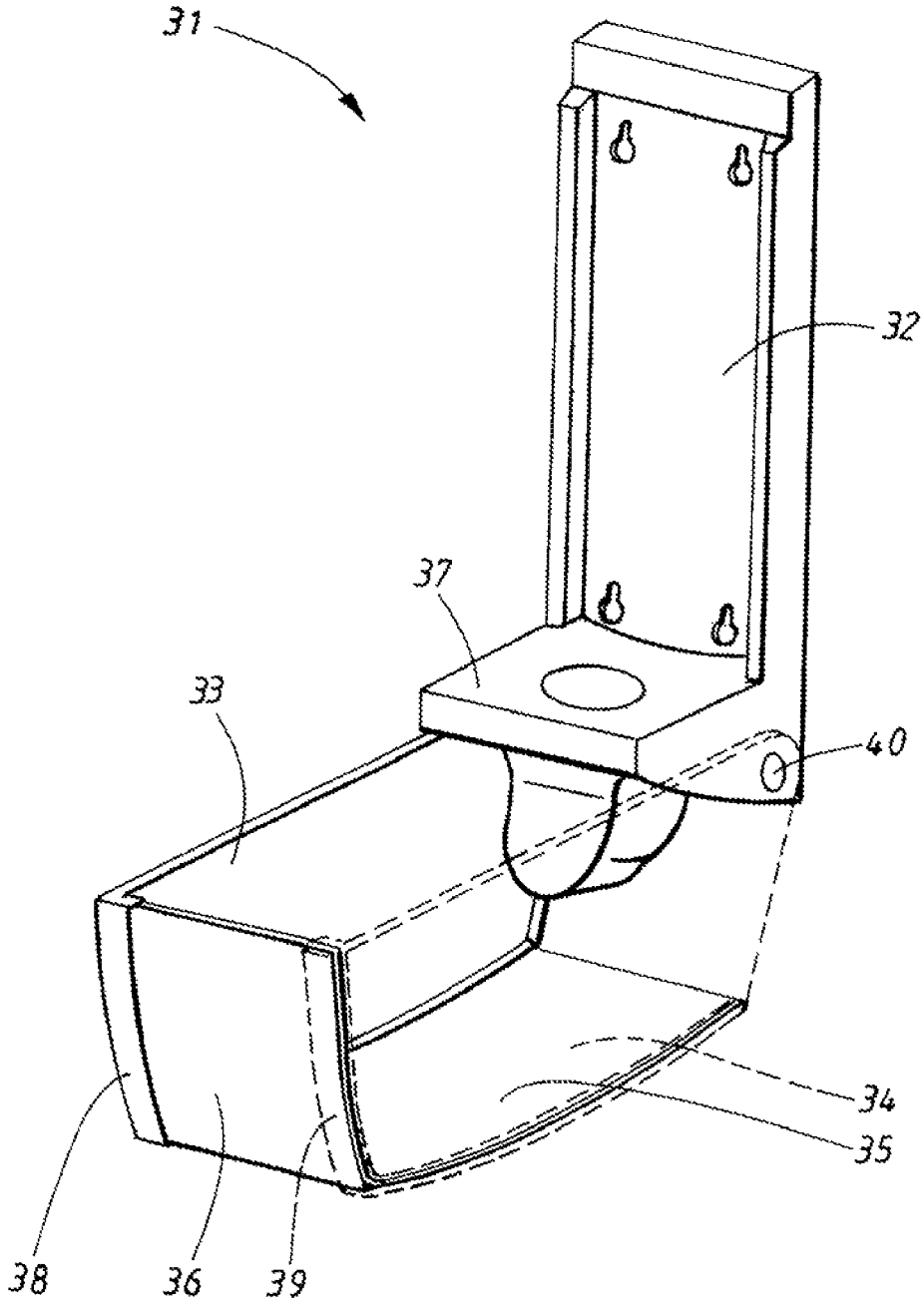
FIG. 3B shows the dispenser in FIG. 3A in an open position.

FIG. 3B shows the dispenser of FIG. 3A in an opened position prior to re-filling the dispenser. The figure shows how a sheet metal cover formed by the side sections 33, 34, the front section 35 and the upper section 36 is attached to the side surfaces of the integrated lower section 37 and the rear section 32 by the pivot joints 40, allowing the cover 33, 34, 35, 36 to be folded forwards and outwards to enable re-filling of the dispenser. The lower section has a cavity for inserting and attaching a re-fill container. In FIG. 3B, one side section 34 has been removed and indicated with dashed lines for clarity. After re-filling the cover 33, 34, 35, 36 is folded back into its closed position, where it is held by a locking means (not shown) connecting the upper section 36 to the rear section 32. As described in connection with FIG. 1B, the rear section 32 is provided with attachment holes for fastening the dispenser to a wall surface.

The invention is not limited to the above embodiments, but may be varied freely within the scope of the claims. Specifically, the various arrangements of the cover for a dispenser, as shown in FIGS. 1A-3B, can each be used for a dispenser for stacked, folded and interfolded paper sheets, for one or two paper rolls with or without perforations, or for a dispenser for liquid or viscous materials.

In addition, by varying the placing of the pivot means, the cover could also be suspended from the upper part of the rear section of the dispenser, causing the cover to be openable outwards and upwards.

The invention claimed is:

1. A dispenser for hygiene products, comprising:

a rear section, two side sections, a front section, an upper section and a lower section having means for dispensing hygiene products, the upper section having a radius of 160-590 mm;

at least the rear section and the two side sections comprising substantially flat components made from a plastic material;

the front section and the upper section forming a single sheet metal component having only one cylindrical single-curvature bend, a radius of the cylindrical single-curvature bend being above about 5 mm, measured at an outer surface of the single sheet metal component;

at least the sheet metal component being arranged to be folded about a pair of pivot devices arranged in the side sections; and said pivot devices being arranged adjacent the lower section, wherein the single sheet metal has a thickness to maintain structural rigidity of the dispenser and to avoid bending when the front section is folded about the pair of pivot devices.

2. The dispenser according to claim 1, wherein at least the front section is substantially flat.

3. The dispenser according to claim 1, wherein at least the front section has the cylindrical single-curvature.

4. The dispenser according to claim 1, wherein the pivot devices connect the sheet metal component and the side sections.

5. The dispenser according to claim 1, wherein the sheet metal component is attached to the side sections and the pivot devices connect the rear section and the side sections.

6. The dispenser according to claim 5, wherein the sheet metal component is permanently attached in slots along front and upper edges of the side sections.

7. The dispenser according to claim 1, wherein the sheet metal component is made from aluminum or an aluminum alloy.

8. The dispenser according to claim 7, wherein the sheet metal component has been anodized on all surfaces.

9. The dispenser according to claim 1, wherein at least the side sections comprise a transparent material.

10. The dispenser according to claim 1, wherein the lower section is integrated with the rear section.

11. The dispenser according to claim 1, wherein the lower section includes means for dispensing liquid or viscous materials.

12. The dispenser according to claim 1, wherein the lower section includes means for dispensing sheets of paper from a stack of sheets or a roll of paper.

13. The dispenser according to claim 1, wherein at least one outer surface of the front section and the upper section should be substantially flush with a front edges of the side sections, when the front section and the upper section are at a closed position.

14. The dispenser according to claim 1, further comprising:

a linkage attached between inner surfaces of the side sections and the lower sections to allow the cover to be folded forwards and outwards.

15. The dispenser according to claim 1, wherein the thickness is about 2-3 mm when the single sheet metal component is made from aluminum while the thickness is about 0.7-1.5 mm when the single sheet metal component is made from stainless steel.

16. The dispenser according to claim 1, wherein the radius is greater than about 5 mm when the single sheet metal component is formed from steel, and the radius is greater than about 8 mm when the single sheet metal component is formed from aluminum.

17. The dispenser according to claim 1, wherein the upper section has a shape of a continuous or discontinuous curve.

18. The dispenser according to claim 1, wherein the front section has a shape of a continuous or discontinuous curve.

19. A dispenser for hygiene products, comprising:

a rear section, two side sections, a front section, an upper section and a lower section having means for dispensing hygiene products, the upper section having a radius of 160-590 mm;

at least the rear section and the two side sections comprising substantially flat components made from a plastic material;

the front section and the upper section forming a single sheet metal component having only one cylindrical single-curvature bend, a radius of the cylindrical single-curvature bend being above about 5 mm, measured at an outer surface of the single sheet metal component;

at least the sheet metal component being arranged to be folded about a pair of pivot devices arranged in the side sections, said sheet metal component being substantially flush with said side sections at said lower section; and said pivot devices being arranged adjacent the lower section, wherein the single sheet metal component has a thickness to maintain structural rigidity of the dispenser and to avoid bending when the front section is folded about the pair of pivot devices.

20. The dispenser according to claim 19, further comprising:

a linkage attached between inner surfaces of the side sections and the lower sections to allow the cover to be folded forwards and outwards.

21. The dispenser according to claim 19, wherein the thickness is about 2-3 mm when the single sheet metal component is made from aluminum while the thickness is about 0.7-1.5 mm when the single sheet metal component is made from stainless steel.

22. The dispenser according to claim 19, wherein the radius is greater than about 5 mm when the single sheet metal component is formed from steel, and the radius is greater than about 8 mm when the single sheet metal component is formed from aluminum.

23. The dispenser according to claim 19, wherein the upper section has a shape of a continuous or discontinuous curve.

24. The dispenser according to claim 19, wherein the front section has a shape of a continuous or discontinuous curve.

25. A dispenser for hygiene products, comprising:

a rear section, two side sections, a front section, an upper section and a lower section having means for dispensing hygiene products, the front section having a radius of 860-2550 mm;

at least the rear section and the two side sections comprising substantially flat components made from a plastic material;

the front section and the upper section forming a single sheet metal component having only one cylindrical single-curvature bend, a radius of the cylindrical single-curvature bend being above about 5 mm, measured at an outer surface of the single sheet metal component;

at least the sheet metal component being arranged to be folded about a pair of pivot devices arranged in the side sections; and said pivot devices being arranged adjacent the lower section, wherein the single sheet metal has a thickness to maintain structural rigidity of the dispenser and to avoid bending when the front section is folded about the pair of pivot devices.

26. A dispenser for hygiene products, comprising:

a rear section, two side sections, a front section, an upper section and a lower section having means for dispensing hygiene products, the front section having a radius of 860-2550 mm;

at least the rear section and the two side sections comprising substantially flat components made from a plastic material;

the front section and the upper section forming a single sheet metal component having only one cylindrical single-curvature bend, a radius of the cylindrical single-curvature bend being above about 5 mm, measured at an outer surface of the single sheet metal component;

at least the sheet metal component being arranged to be folded about a pair of pivot devices arranged in the side sections, said sheet metal component being substantially flush with said side sections at said lower section; and said pivot devices being arranged adjacent the lower section, wherein the single sheet metal component has a thickness to maintain structural rigidity of the dispenser and to avoid bending when the front section is folded about the pair of pivot devices.

* * * * *